US009949604B2

(12) United States Patent
Quinn et al.

(10) Patent No.: US 9,949,604 B2
(45) Date of Patent: Apr. 24, 2018

(54) VACUUM CLEANER INCLUDING A BELT TENSIONER

(71) Applicant: Techtronic Industries Co. Ltd., Tsuen Wan, New Territories (HK)

(72) Inventors: Patrick Quinn, North Canton, OH (US); John Bantum, Munroe Falls, OH (US); Michael Wright, Glenwillow, OH (US); Rafael Davila, Glenwillow, OH (US); Yiping Guan, Aurora, OH (US)

(73) Assignee: Techtronic Industries Co. Ltd., Tsuen Wan, New Territories (HK)

( * ) Notice: Subject to any disclaimer, the term of this patent is extended or adjusted under 35 U.S.C. 154(b) by 0 days.

(21) Appl. No.: 15/302,318

(22) PCT Filed: Apr. 8, 2015

(86) PCT No.: PCT/US2015/024951
§ 371 (c)(1),
(2) Date: Oct. 6, 2016

(87) PCT Pub. No.: WO2015/157435
PCT Pub. Date: Oct. 15, 2015

(65) Prior Publication Data

US 2017/0020350 A1 Jan. 26, 2017

Related U.S. Application Data

(60) Provisional application No. 61/977,468, filed on Apr. 9, 2014.

(51) Int. Cl.
*A47L 9/04* (2006.01)
*A47L 5/30* (2006.01)
(Continued)

(52) U.S. Cl.
CPC ..... *A47L 9/0444* (2013.01); *A47L 5/30* (2013.01); *A47L 9/0455* (2013.01);
(Continued)

(58) Field of Classification Search
CPC ..... A47L 9/0444; A47L 5/30; A47L 9/0455; A47L 9/0477; A47L 9/1683; A47L 9/325
See application file for complete search history.

(56) References Cited

U.S. PATENT DOCUMENTS 5,031,267 A * 7/1991 Bewley ..... A47L 9/0411 15/377
5,537,712 A * 7/1996 Weber ..... A47L 5/26 15/332

(Continued)

FOREIGN PATENT DOCUMENTS

EP 2567649 A1 3/2013

OTHER PUBLICATIONS

International Search Report and Written Opinion for Application No. PCT/US2015/024951 dated Jul. 17, 2015 (12 pages).

*Primary Examiner* — Dung Van Nguyen
(74) *Attorney, Agent, or Firm* — Michael Best & Friedrich LLP

(57) ABSTRACT

A drive mechanism for a vacuum cleaner having a motor and an agitator includes a belt coupled to the motor and the agitator to drive the agitator, and a belt tensioner operable to selectively tension the belt. The belt tensioner includes an arm movable relative to the belt, a shaft coupled to the arm, a pulley rotatably coupled to the shaft, a bearing positioned substantially within the pulley and around a portion of the shaft, and a member fixed to the pulley to retain the bearing within the pulley.

16 Claims, 10 Drawing Sheets

(51) Int. Cl.
*A47L 9/16* (2006.01)
*A47L 9/32* (2006.01)

(52) U.S. Cl.
CPC ..... *A47L 9/0477* (2013.01); *A47L 9/1683* (2013.01); *A47L 9/325* (2013.01)

(56) References Cited

U.S. PATENT DOCUMENTS

| | | | | |
|---|---|---|---|---|
| 2008/0271285 | A1 | 11/2008 | Maurer et al. | |
| 2011/0078874 | A1 | 4/2011 | Dever | |
| 2013/0055526 | A1* | 3/2013 | Tran | A47L 9/0444 15/383 |

* cited by examiner

VACUUM CLEANER INCLUDING A BELT TENSIONER

CROSS-REFERENCE TO RELATED APPLICATIONS

This application claims priority to U.S. Provisional Patent Application No. 61/977,468, filed Apr. 9, 2014, the entire contents of which are incorporated by reference herein.

BACKGROUND

The present invention relates to vacuum cleaners and, more particularly, to belt tensioners for vacuum cleaners.

SUMMARY

In one embodiment, the invention provides a drive mechanism for a vacuum cleaner. The vacuum cleaner includes a motor and an agitator. The drive mechanism includes a belt coupled to the motor and the agitator to drive the agitator, and a belt tensioner operable to selectively tension the belt. The belt tensioner includes an arm movable relative to the belt, a shaft coupled to the arm, a pulley rotatably coupled to the shaft, a bearing positioned substantially within the pulley and around a portion of the shaft, and a member fixed to the pulley to retain the bearing within the pulley.

In another embodiment, the invention provides a vacuum cleaner including a base having a suction nozzle, a dirt collection assembly configured to receive an airflow from the suction nozzle, a motor, and an agitator positioned within the base. The vacuum cleaner also includes a belt coupled to the motor and the agitator to drive the agitator, and a belt tensioner operable to selectively tension the belt. The belt tensioner includes an arm movable relative to the belt, a shaft coupled to the arm, a pulley rotatably coupled to the shaft, a bearing positioned substantially within the pulley and around a portion of the shaft, and a member fixed to the pulley to retain the bearing within the pulley.

In yet another embodiment, the invention provides a pulley assembly operable to engage a belt in a floor cleaning machine. The pulley assembly includes a pulley rotatable about a shaft. The pulley has a belt-engaging surface about an axis, and a bore along the axis. The pulley assembly also includes a bearing positioned in the bore, and a member retaining the bearing within the bore. The member bounds axial movement of the bearing in the bore.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
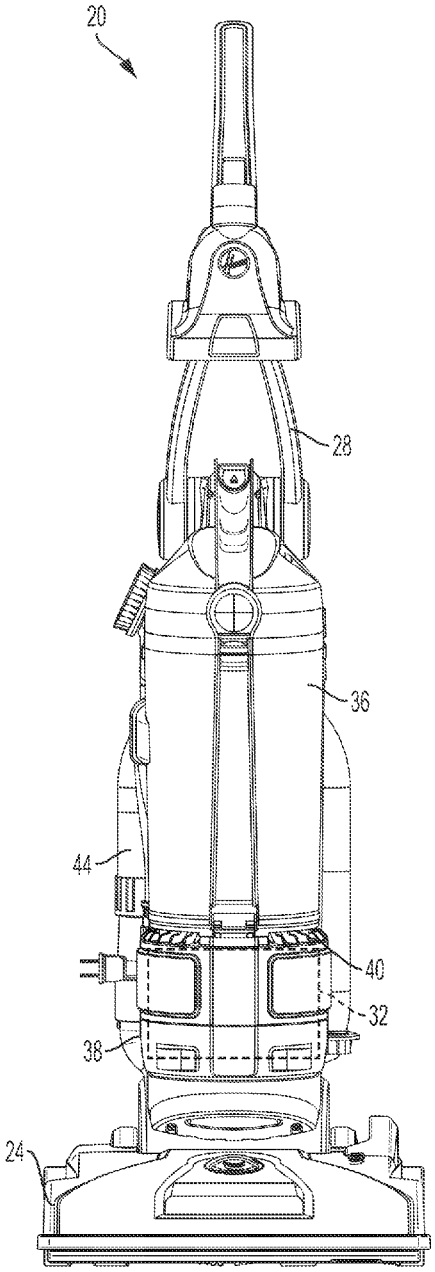
FIG. 1 is a front view of a vacuum cleaner.
Figure 2:
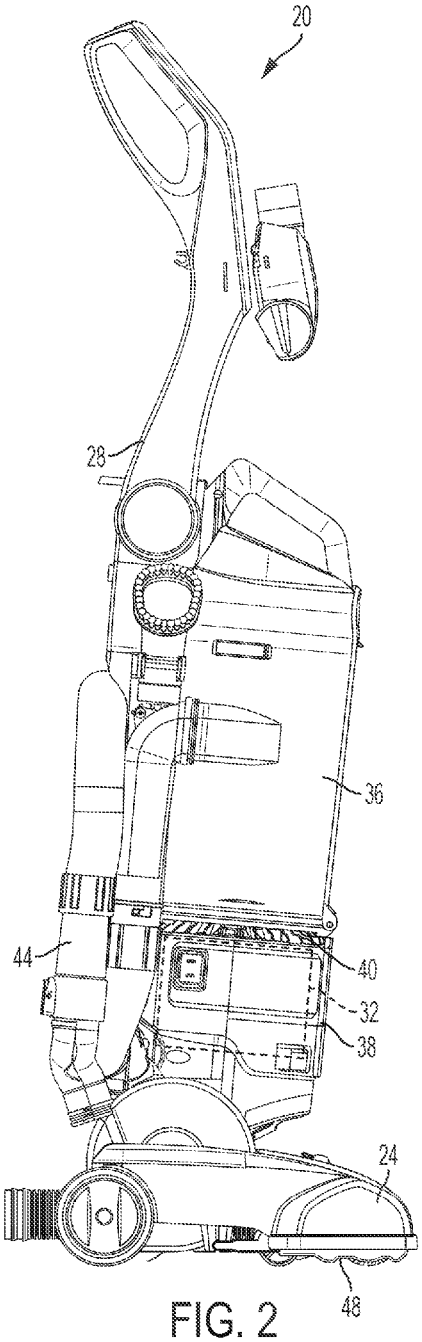
FIG. 2 is a side view of the vacuum cleaner.

FIGS. 1 and 2 illustrate a vacuum cleaner 20. The illustrated vacuum cleaner 20 is an upright vacuum cleaner including a base 24, a handle assembly 28, a suction motor 32, and a dirt collection assembly 36. The base 24 is movable along a surface to be cleaned, such as a carpet or hard-surface floor, and includes a suction nozzle 48. The suction nozzle 48 is fluidly connected to the dirt collection assembly 36 by a hose 44. The suction motor 32 draws an airflow from the surface into the vacuum cleaner 20.

The handle assembly 28 is pivotally coupled to the base 24 for movement between an upright storage position, where the handle assembly 28 extends at a substantially 90 degree angle from the base 24, and an inclined operating position to facilitate moving the vacuum cleaner along the surface to be cleaned.

The suction motor 32 is positioned within a motor housing 38, which may be supported on the handle assembly 28. The suction motor 32 includes a fan that generates a suction force through the dirt collection assembly 36 and the suction nozzle 48 to draw an airflow into the vacuum cleaner. The motor housing 38 defines exhaust vents 40 that exhaust the airflow (after the airflow is cleaned) back into the surrounding environment. In the illustrated embodiment, the suction motor 32 is positioned below both the dirt collection assembly 36 and the exhaust vent 40.

The illustrated dirt collection assembly 36 includes a dirt separator and a collection chamber and is supported by the handle assembly 28. The dirt separator uses suction force generated by the motor 32 to separate dirt, dust, and other particles from the airflow. In some embodiments, the dirt separator may include a cyclonic separator assembly. In other embodiments, the dirt separator may include a bag. Once separated from the airflow, the dirt, dust, or other particles are then stored in the collection chamber. The illustrated dirt collection assembly 36 is removable from the handle assembly 28 to empty the collection chamber.

In operation, the suction motor 32 generates a suction force to draw an airflow through the suction nozzle 48. The airflow is directed through the base 24 and into the hose 44. The hose 44 directs the airflow into the dirt collection assembly 36. The dirt separator of the dirt collection assembly 36 separates dirt, dust, and other particles out of the airflow. A relatively clean airflow is then directed into the motor housing 38 and exhausted out of the vacuum cleaner through the exhaust vents 40. Although the illustrated vacuum cleaner 20 is an upright vacuum cleaner, in other embodiments, the vacuum cleaner 20 may be a different type of floor cleaning machine, such as a canister vacuum cleaner or an extractor.

Figure 3:
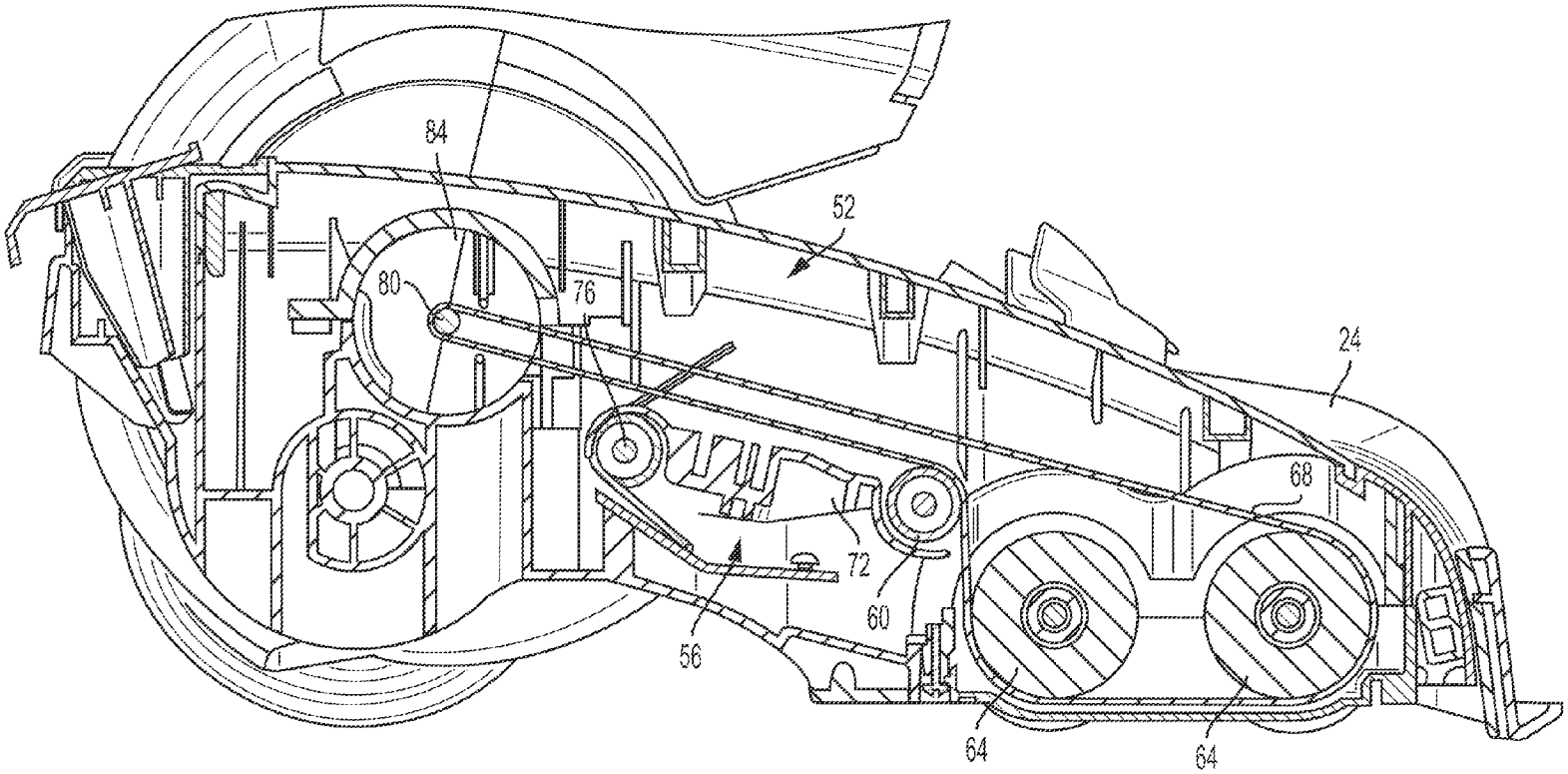
FIG. 3 is a cross-sectional view of a base of the vacuum cleaner.

For example, FIG. 3 illustrates the base 24 of an extractor. The base 24 of the extractor is similar to the base of the vacuum cleaner 20 discussed above. In the illustrated embodiment, the extractor includes a motor 84 and two agitators 64 positioned within the base 24. Although the illustrated extractor includes two agitators 64, or brushrolls, in other embodiments the extractor may include a single agitator. The extractor also includes a drive mechanism 52 operable in a variety of different cleaning modes to selectively drive the agitators 64. The illustrated drive mechanism 52 includes a belt 68 coupled with the agitators 64 and a motor shaft 80. The belt 68 can be tensioned (as shown in FIG. 3) and untensioned by a belt tensioner 56 of the drive mechanism 52. The belt tensioner 56 includes a pulley assembly 60 and an arm 72. The arm 72 is rotatably coupled to the base 24 at a pivot shaft 76 to move the pulley assembly 60 toward and away from the belt 68. While in a hard-surface cleaning mode, the pulley assembly 60 is moved away from the belt 68 so that the belt 68 is untensioned and the agitators 64 are not rotated. While in a carpet cleaning mode, the pulley assembly 60 engages the belt 68 so that the belt 68 is tensioned and the agitators 64 rotate.

As shown in FIG. 3, the belt 68 is driven by the motor shaft 80 of the motor 84 housed within the base 24. In other embodiments, the suction motor 32 (FIG. 1) may be located in the base 24 so that the belt 68 may be driven by the suction motor 32. In such embodiments, a single motor may both provide the suction force and rotate the agitators 64. In the illustrated embodiment, the motor shaft 80, being coupled with the belt 68, is capable of converting power from the motor 84 to rotational movement of the agitators 64.

In the illustrated embodiment, the belt tensioner 56 is movable (e.g., pivotable) between a first, tensioned position (as shown in FIG. 3) and a second, untensioned position. When in the tensioned position, the pulley assembly 60 engages the belt 68 to tension the belt 68. When in the untensioned position, the pulley assembly 60 does not apply sufficient force to the belt 68 to tension the belt 68. In some embodiments, the belt tensioner 56 is moved between the tensioned and untensioned positions by a manual actuator. When actuated, the manual actuator pivots the arm 72 about an axis defined by the longitudinal direction of the pivot shaft 76. The axis defined by the pivot shaft 76 is generally parallel to an axis defined by the longitudinal direction of the agitator 64 and is generally parallel to a rotational axis of the pulley assembly 60.

Figure 4:
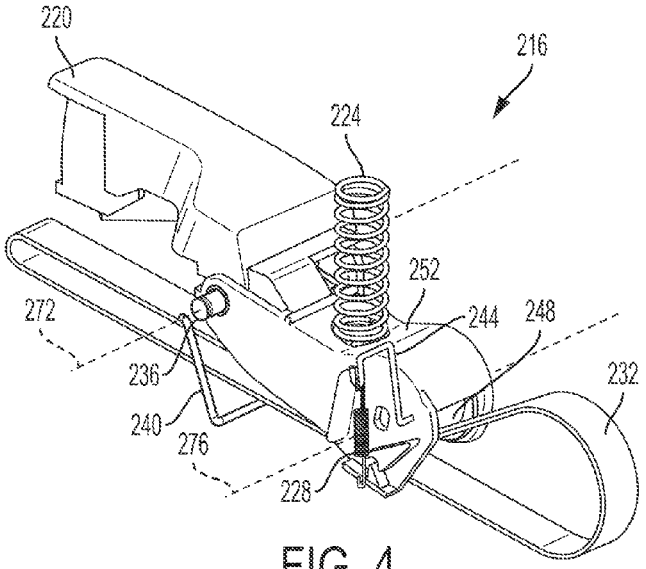
FIG. 4 is a perspective view of a belt tensioner for use with the vacuum cleaner.
Figure 5:
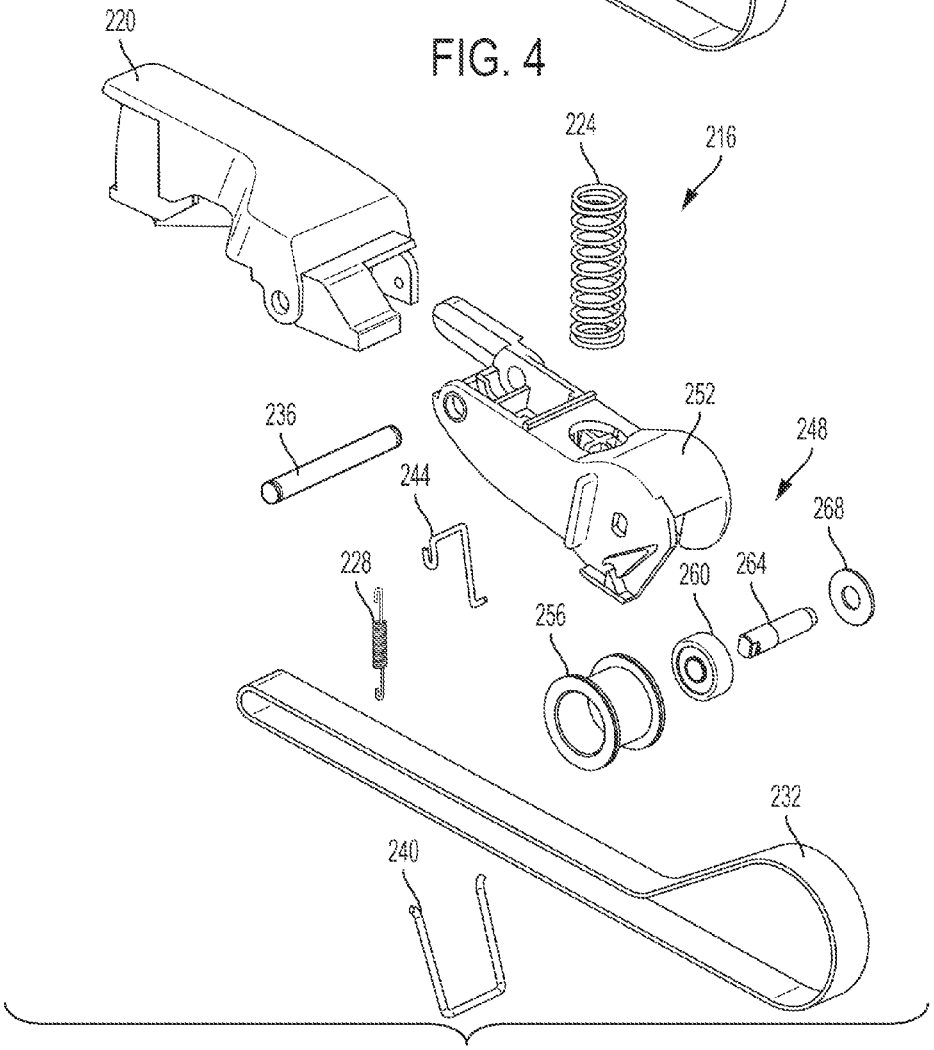
FIG. 5 is an exploded perspective view of the belt tensioner of FIG. 4.

FIGS. 4 and 5 illustrate another belt tensioner 216 that can be used in the drive mechanism 52 of the vacuum cleaner 20 or extractor. The belt tensioner 216 operates in a substantially similar manner to the belt tensioner 56 discussed above, but is located above (rather than below) a belt 232. The illustrated belt tensioner 216 includes a manual actuator 220 (e.g., a foot pedal), a spring 224, a lock spring 228, a pivot shaft 236, a level 240, a locking pin 244, a pulley assembly 248, and an arm 252. The pulley assembly 248 is a conventional pulley assembly and includes a pulley 256, a bearing 260, a shaft 264, and a washer 268. In the illustrated embodiment, the actuator 220 is capable of moving the belt tensioner 216, specifically the pulley assembly 248, to apply tension or to release tension on the belt 232. When the belt tensioner 216 is in a disengaged position, the belt 232 is untensioned and does not rotate an agitator. When the actuator 220 is actuated by a user, the arm 252 pivots about a first axis 272, which is defined by the longitudinal length of the pivot shaft 236. The first axis 272 is generally parallel to a second axis 276, which is defined by the longitudinal length of the shaft 264 about which the pulley 260 rotates. When the belt tensioner 216 is in an engaged position, the belt 232 is tensioned to rotate the agitator.

To move the belt tensioner 216 from the engaged position (shown in FIG. 4) to the disengaged position (not shown), the user presses the actuator 220 to lift the arm 252 such that the locking pin 244 slides along a cam surface on the arm 252, and the locking pin 244 slides down the cam surface until the locking pin 244 contacts a bottom surface. The locking pin 244 is biased toward the agitator (i.e., to the right in FIG. 4). When the user releases the actuator 220, the lock spring 228 biases the pulley assembly 248 such that the locking pin 244 moves toward and becomes trapped within a recess. The locking pin 244 remains in the recess when the arm 252 is in the disengaged position to hold the pulley assembly 248 above the belt 232 such that there is no tension applied to the belt 232. To reengage the arm 252, the user again presses the actuator 220 to move the locking pin 244 down toward the bottom of the cam surface. The actuator 220 is moved enough by the user such that the locking pin 244 clears the corner of the recess so that when the user releases the actuator 220, the spring 224 returns the belt tensioner 216 to the engaged position.

Figure 7:
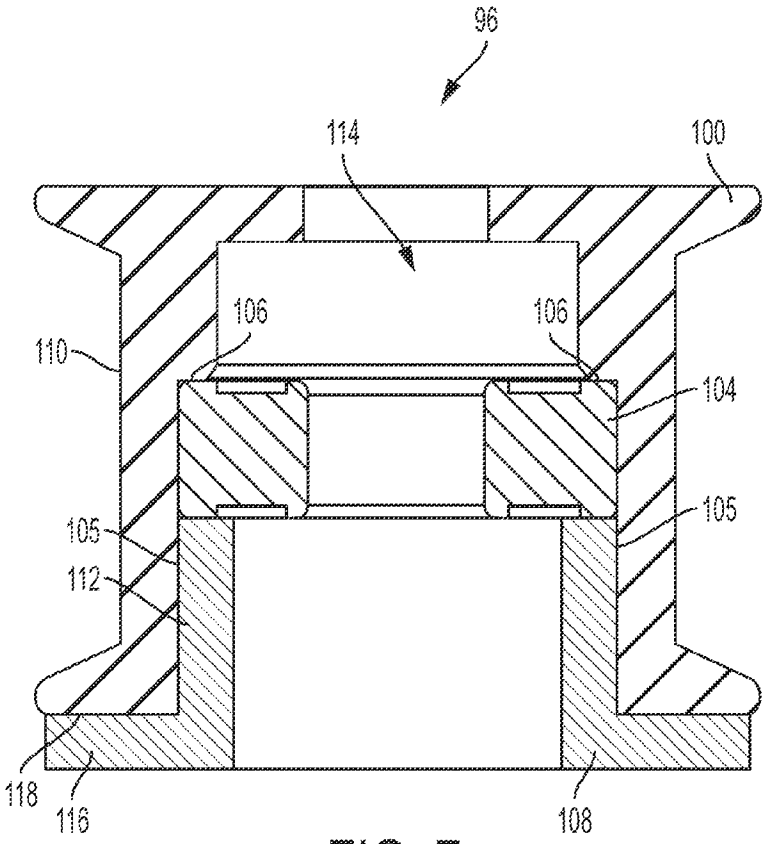
FIG. 7 is a cross-sectional view of the pulley assembly of FIG. 6.
Figure 6:
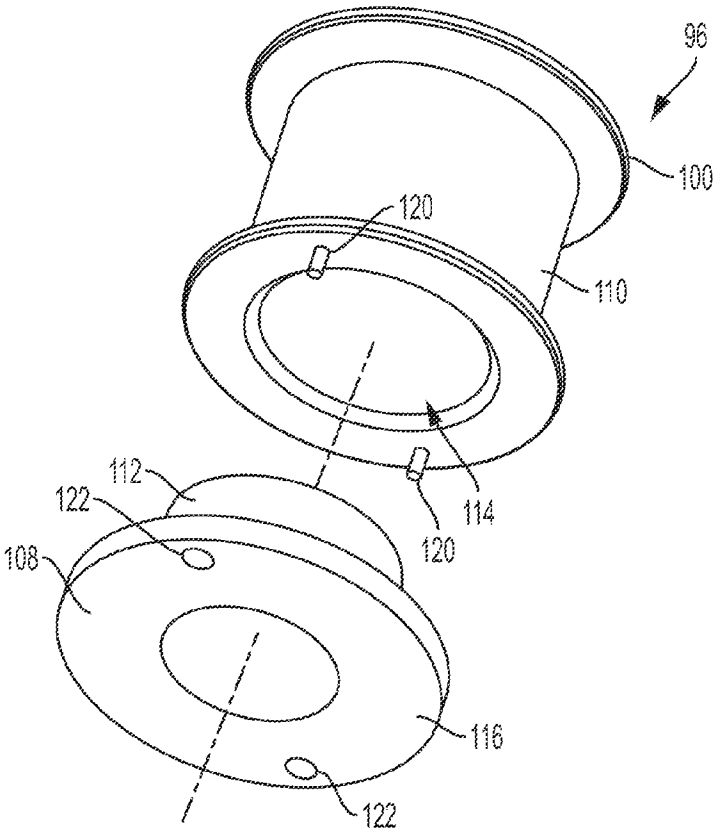
FIG. 6 is an exploded perspective view of a pulley assembly of a belt tensioner embodying the invention.

FIGS. 6 and 7 illustrate a first alternative pulley assembly 96 for use with the belt tensioner 56 (FIG. 3) or the belt tensioner 216 (FIGS. 4-5). The pulley assembly 96 includes a pulley 100 rotatable about a shaft (e.g., the shaft 264 shown in FIG. 5). The pulley 100 has a belt-engaging surface 110 about an axis, and a bore 105 along the axis having a seat portion 106. The assembly 96 also includes a bearing 104 positioned in the bore 105 adjacent the seat portion 106, and a member 108 retaining the bearing 104 adjacent the seat portion 106. The seat portion 106 and the member 108 bound axial movement of the bearing 104 in the bore 105. The pulley 100 includes the outer surface 110 configured to engage a belt to selectively tension the belt. The pulley 100 is rotatably supported on the shaft by the bearing 104. The bore 105 may be a stepped bore, the seat portion 106 (or inner shoulder) being formed by a step of the stepped bore. The bearing 104 is positioned substantially within the pulley 100 and around a portion of the shaft. The member 108 is fixed to the pulley 100 and engages the bearing 104 to retain the bearing 104 within the pulley 100. Stated another way, the member 108 inhibits the pulley 100 from moving (e.g., sliding laterally) off of the bearing 104.

In FIGS. 6 and 7, the illustrated member 108 is a bushing that engages the bearing 104 to inhibit the pulley 100 from moving off of the bearing 104. The bushing 108 surrounds a portion of the shaft and fits within the pulley 100. In the illustrated embodiment, the bushing 108 includes a small diameter portion 112 that extends into a cavity 114 of the pulley 100 to engage the bearing 104, and a large diameter flange portion 116 that abuts an outer axial face 118 of the pulley 100. The bushing 108 may be fixed to the pulley 100 by posts 120. Each post 120 fits within a corresponding aperture 122 in the flange 116 of the bushing 108. Once the posts 120 are properly inserted into the apertures 122, the bushing 108 is permanently fixed to the pulley 100 by, for example, ultrasonic welding or heat staking of the posts 120.

Figure 9:
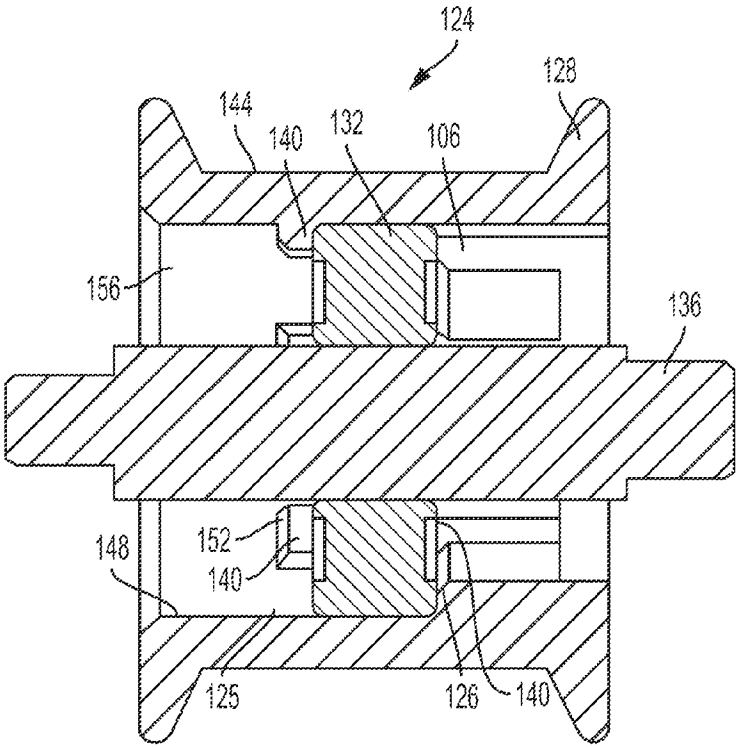
FIG. 9 is a cross-sectional view of the pulley assembly of FIG. 8.
Figure 8:
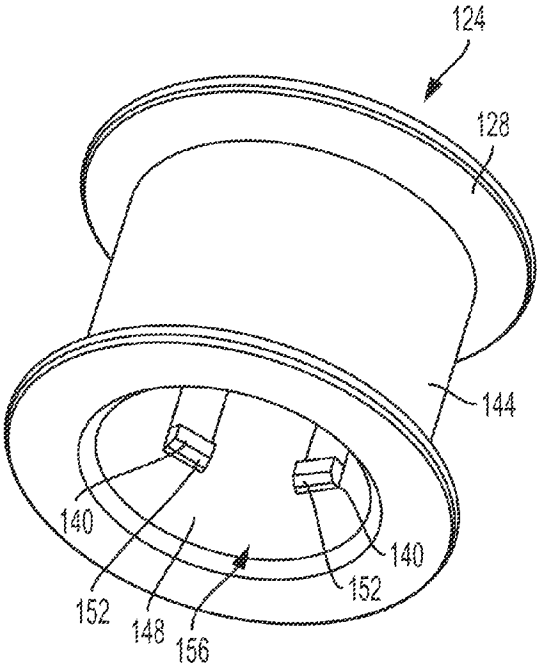
FIG. 8 is a perspective view of another pulley assembly embodying the invention.

FIGS. 8 and 9 illustrate another pulley assembly 124 for use with the belt tensioner 56 (FIG. 3) or the belt tensioner 216 (FIGS. 4-5). The pulley assembly 124 includes a pulley 128, a bearing 132, a shaft 136, and members 140. The pulley 128 includes an outer surface 144 configured to engage a belt to selectively tension the belt. The pulley 128 is rotatably supported on the shaft 136 by the bearing 132. The bearing 132 is positioned substantially within the pulley 128 and around a portion of the shaft 136. The members 140 are formed on the pulley 128 and engage the bearing 132 to retain the bearing 132 within the pulley 128 (i.e., to inhibit the pulley 128 from moving off of the bearing 132).

The illustrated members 140 are projections, or tabs, formed on an inner surface 148 of the bore 125. Each projection 140 includes a chamfered surface 152 to help snap-fit the bearing 132 upon installation of the bearing 132 over the projections 140 inside a cavity 156 of the pulley 128, the member 140 retaining the bearing 132 adjacent a seat portion 126 of the pulley 128. In one embodiment, the member 140 is a series of projections that are staggered in an axial direction to engage both sides or faces of the bearing 132. Once the bearing 132 is positioned between the projections 140, the bearing 132 is fixed within the cavity 156 of the pulley 128 to inhibit removal of the bearing 132 from the pulley 128. In one alternative with projections 140 engaging both sides or faces of the bearing 132, the seat portion 126 is omitted.

Figure 11:
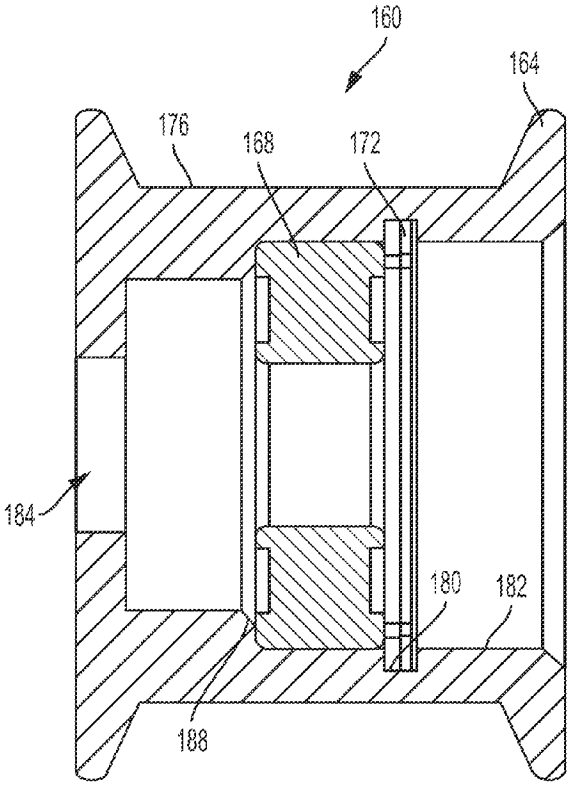
FIG. 11 is a cross-sectional view of the pulley assembly of FIG. 10.
Figure 10:
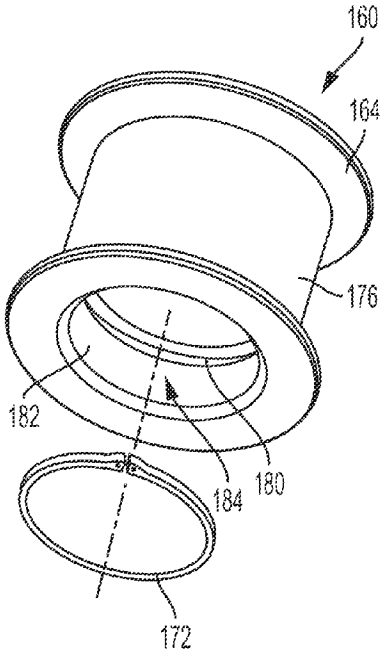
FIG. 10 is an exploded perspective view of another pulley assembly embodying the invention.

FIGS. 10 and 11 illustrate another pulley assembly 160 for use with the belt tensioner 56 (FIG. 3) or the belt tensioner 216 (FIGS. 4-5). The pulley assembly 160 includes a pulley 164, a bearing 168, a shaft (e.g., the shaft 264 shown in FIG. 5), and a member 172. The pulley 164 includes an outer surface 176 configured to engage a belt to selectively tension the belt. The pulley 164 is rotatably supported on the shaft by the bearing 168. The bearing 168 is positioned substantially within the pulley 164 and around a portion of the shaft. The member 172 is secured to the pulley 164 and engages the bearing 168 to retain the bearing 168 within the pulley 164 (i.e., to inhibit the pulley 164 from moving off of the bearing 168).

The illustrated member 172 is a retaining ring that fits within a groove 180 formed on an inner surface 182 of the pulley 164. The retaining ring 172 captures the bearing 168 within a cavity 184 of the pulley 164 between a seat portion 188 of the pulley 164 and the retaining ring 172. The retaining ring 172 may be a snap ring, c-clip, e-clip, spring clip, wave spring, wire form, spiral ring, or other retaining ring. When the retaining ring 172 is positioned within the groove 180, the bearing 168 is fixed within the cavity 184 of the pulley 164 to inhibit removal of the bearing 168 from the pulley 164. The retaining ring 172 is also removable from the groove 180 to allow removal of the bearing 168 from the pulley 164.

Figure 13:
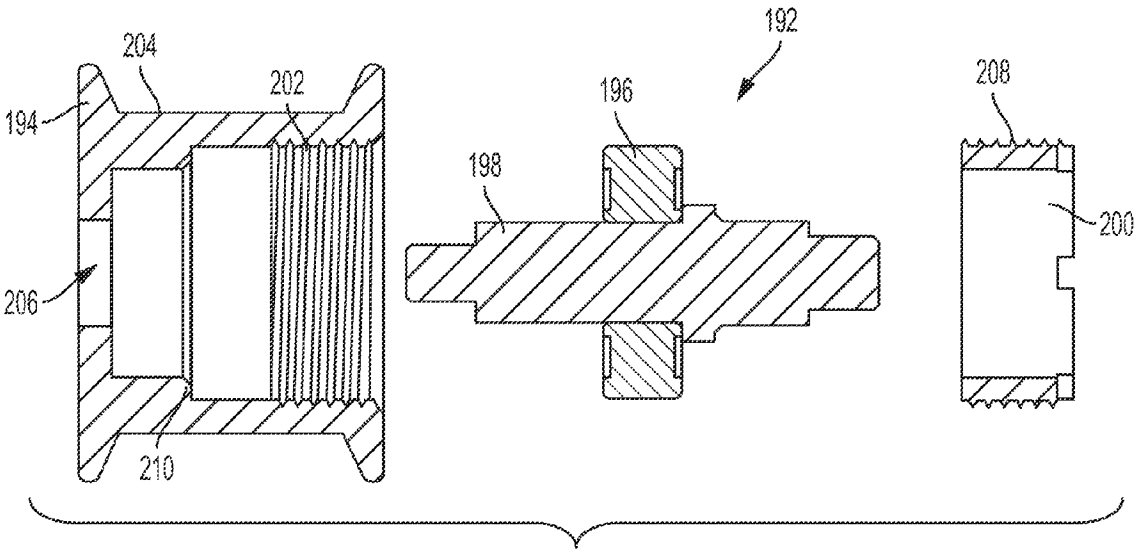
FIG. 13 is an exploded, cross-sectional view of the pulley assembly of FIG. 12.
Figure 12:
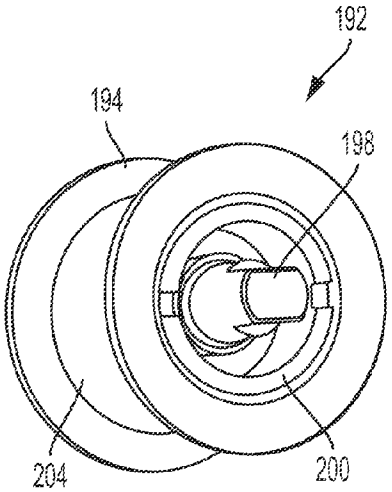
FIG. 12 is a perspective view of another pulley assembly embodying the invention.
Figure 14:
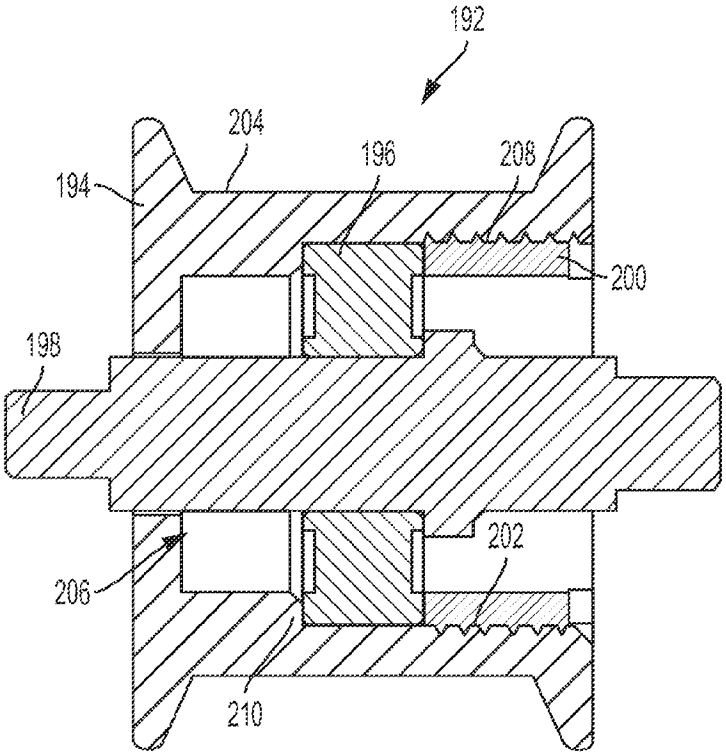
FIG. 14 is a cross-sectional view of the pulley assembly of FIG. 12.

FIGS. 12-14 illustrate another pulley assembly 192 for use with the belt tensioner 56 (FIG. 3) or the belt tensioner 216 (FIGS. 4-5). The pulley assembly 192 includes a pulley 194, a bearing 196, a shaft 198, and a member 200. The pulley 192 includes a threaded inner surface 202 and an outer surface 204. The outer surface 204 is configured to engage a belt to selectively tension the belt. The bearing 196 is positioned substantially within a cavity 206 of the pulley 194. The pulley 194 is rotatably supported on the shaft 198 by the bearing 196. The shaft 198 includes a radially-extending shoulder 206 that engages one side or face of the bearing 196. The member 200 is secured to the pulley 194 and also engages the same side of the bearing 196 as the shaft 198 to retain the bearing 196 within the pulley 194 (i.e., to inhibit the pulley 194 from moving off of the bearing 200).

The illustrated member 200 is a threaded bushing. The bushing 200 includes an outer threaded surface 208 that engages the inner threaded surface 202 of the pulley 194. When threaded into the pulley 194, the bushing 200 surrounds a portion of the shaft 198 and is positioned entirely within the pulley 194. The bushing 200 captures the bearing 196 within the cavity 206 of the pulley 194 between a seat portion 210 of the pulley 194 and the bushing 200. In this position, the bushing 200 inhibits removal of the bearing 196 from the pulley 194. The bushing 200 is also removable (e.g., un-threadable) from the pulley 194 to allow removal of the bearing 196 from the pulley 194.

Figure 15:
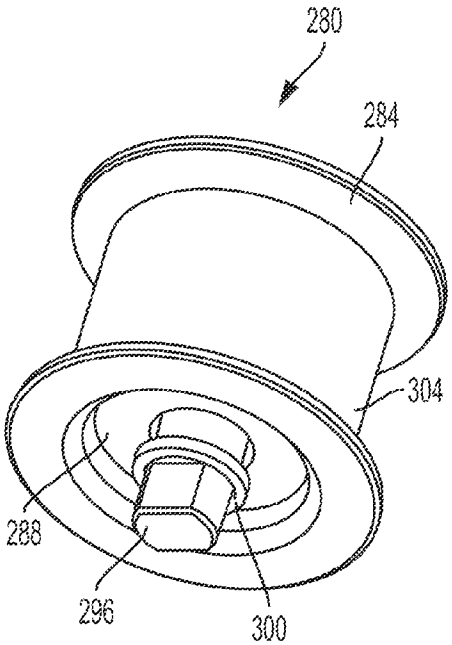
FIG. 15 is a perspective view of another pulley assembly embodying the invention.
Figure 16:
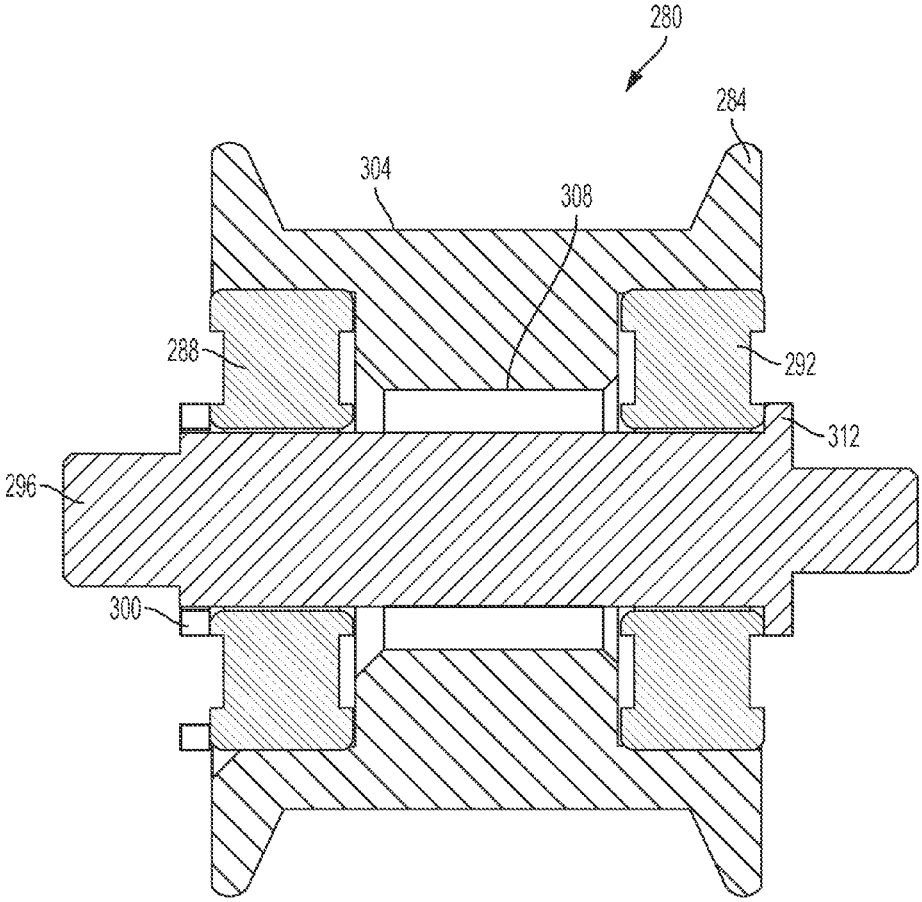
FIG. 16 is a cross-sectional view of the pulley assembly of FIG. 15.

FIGS. 15 and 16 illustrate another pulley assembly 280 for use with the belt tensioner 56 (FIG. 3) or the belt tensioner 216 (FIGS. 4-5). The pulley assembly 280 includes a pulley 284, two bearings 288, 292, a shaft 296, and a member 300. The pulley 284 includes an outer surface 304 that is configured to engage a belt to selectively tension the belt. The pulley 284 is rotatably supported on the shaft 296 by the bearings 288, 292. The bearings 288, 292 are positioned substantially within the pulley 284 and around portions of the shaft 296. The illustrated bearings 288, 292 are spaced apart on opposing sides of a central annular shoulder 308 of the pulley 284 so that the bearings 288, 292 are located adjacent opposing ends of the pulley 284. The first bearing 288 is captured between the member 300 and the central shoulder 308 of the pulley 284 to retain the bearing 288 within the pulley 284 (i.e., to inhibit the pulley 284 from moving off of the shaft 296). The second bearing 292 is captured between a shoulder 312 of the shaft 296 and the central shoulder 308 of the pulley 284 to retain the bearing 292 within the pulley 284 (i.e., to inhibit the pulley 284 from moving off of the shaft 296).

The illustrated member 300 is a stop ring secured to the shaft 296. The stop ring 300 surrounds all or a portion of the shaft adjacent an end of the shaft 296 opposite from the shoulder 312. As such, the pulley 284 and the bearings 288, 292 are generally captured between the stop ring 300 and the shoulder 312 of the shaft 296. The stop ring 300 may be a sleeve or collar pressed, peened, welded, threaded, or otherwise attached to the shaft. Alternatively, the stop ring 300 may be a retaining ring such as a c-clip, e-clip, spring clip, or other clip or fastener attached to a groove or aperture in the shaft. In some embodiments, the stop ring 300 may be press-fit onto the shaft 296. In other embodiments, the stop ring 300 may be welded to the shaft 296. In further embodiments, the stop ring 300 may be secured to the shaft 296 with adhesives. When assembled, the stop ring 300 and the shoulder 312 of the shaft 296 inhibit removal of the bearings 288, 292 from the pulley 284.

Figure 18:
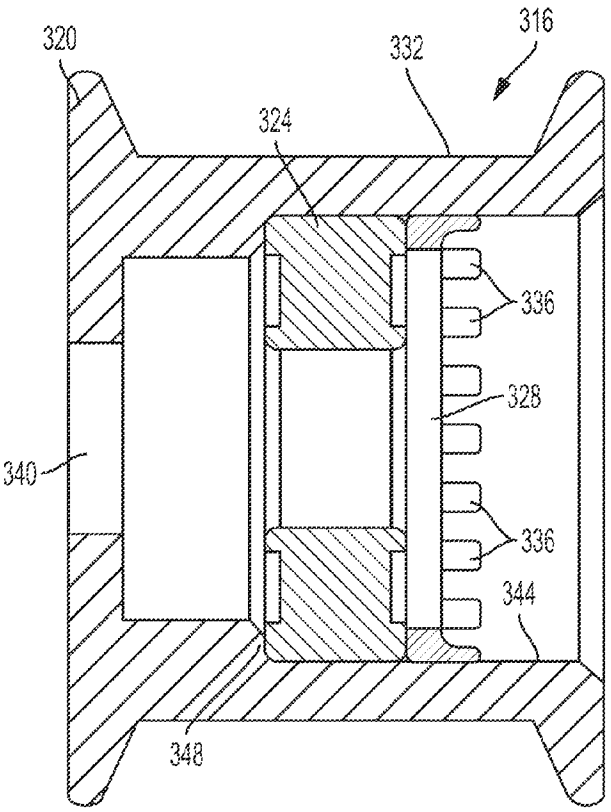
FIG. 18 is a cross-sectional view of the pulley assembly of FIG. 17.
Figure 17:
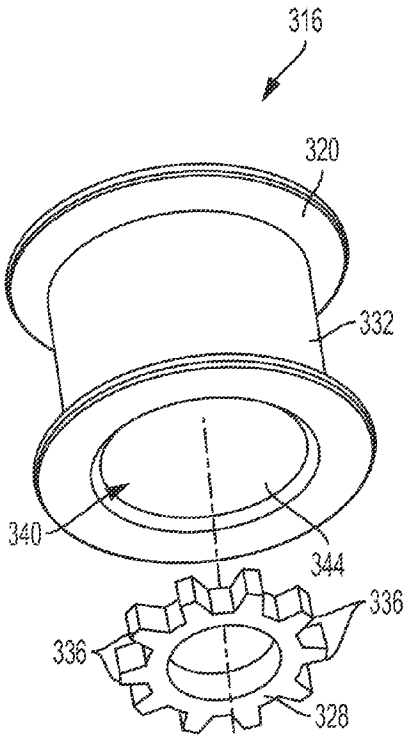
FIG. 17 is an exploded perspective view of another pulley assembly embodying the invention.

FIGS. 17 and 18 illustrate another pulley assembly 316 for use with the belt tensioner 56 (FIG. 3) or the belt tensioner 216 (FIGS. 4-5). The pulley assembly 316 includes a pulley 320, a bearing 324, a shaft (e.g., the shaft 264 shown in FIG. 5), and a member 328. The pulley 320 includes an outer surface 332 configured to engage a belt to selectively tension the belt. The pulley 320 is rotatably supported on the shaft by the bearing 324. The bearing 324 is positioned substantially within the pulley 320 and around a portion of the shaft. The member 328 is secured to the pulley 320 and engages the bearing 324 to retain the bearing 324 within the pulley 320 (i.e., to inhibit the pulley 320 from moving off of the bearing 324).

The illustrated member 328 is a member having external radial projections 336. The projections 336 have an outer diameter that is larger than an inner diameter of the pulley 320. As such, when the member 328 is pressed or inserted into a cavity or bore 340 of the pulley 320, the projections 336 of the member 328 engage an inside surface 344 of the bore 340 with an interference fit. In some embodiments, the projections 336 deflect as they engage the inner surface 344 of the pulley 320 with an interference fit. In other embodiments, the projections 336 may deflect or gouge the inside surface 344 of the pulley 320 as the member 328 is inserted. The member 328 captures the bearing 324 between the member 328 and a seat portion 348 formed by the bore 340 to inhibit removal of the bearing 324 from the pulley 320.

The pulley in any of the above embodiments may be made of a thermoplastic material. For example, the pulley may be molded from materials such as polypropylene, polyethylene, polyacetal, acrylonitrile butadiene styrene, polystyrene, nylon or polyamide, or any other thermoplastic material desirable for the application. Alternatively, the pulley may be made from metal such as aluminum, magnesium, steel, or other metal desirable for the application.

Various features and advantages of the invention are set forth in the following claims.

What is claimed is:

1. A drive mechanism for a vacuum cleaner, the vacuum cleaner including a motor and an agitator, the drive mechanism comprising:
- a belt coupled to the motor and the agitator to drive the agitator; and
- a belt tensioner operable to selectively tension the belt, the belt tensioner including
  - an arm movable relative to the belt,
  - a shaft coupled to the arm,
  - a pulley including a seat portion, the pulley rotatably coupled to the shaft,
  - a bearing positioned adjacent the seat portion and substantially within the pulley, the bearing positioned around a portion of the shaft, and
- a member fixed to the pulley and retaining the bearing within the pulley.

2. The drive mechanism of claim 1, wherein the member includes a bushing positioned at least partially within the pulley, and wherein the bushing engages the bearing to inhibit the pulley from moving off of the bearing.

3. The drive mechanism of claim 2, wherein the bushing is permanently fixed to the pulley.

4. The drive mechanism of claim 2, wherein the bushing threadably engages the pulley.

5. The drive mechanism of claim 1, wherein the pulley defines a groove on an inner surface of the pulley, wherein the member includes a retaining ring positioned within the groove, and wherein the retaining ring engages the bearing to inhibit the pulley from moving off of the bearing.

6. The drive mechanism of claim 1, wherein the bearing is a first bearing positioned adjacent a first end of the pulley, and further comprising a second bearing positioned adjacent a second end of the pulley.

7. A vacuum cleaner comprising:
- a base including a suction nozzle;
- a dirt collection assembly configured to receive an airflow from the suction nozzle;
- a motor;
- an agitator positioned within the base;
- a belt coupled to the motor and the agitator to drive the agitator; and
- a belt tensioner operable to selectively tension the belt, the belt tensioner including
  - an arm movable relative to the belt,
  - a shaft coupled to the arm,
  - a pulley including a seat portion, the pulley rotatably coupled to the shaft,
  - a bearing positioned adjacent the seat portion and substantially within the pulley, the pulley positioned around a portion of the shaft, and
  - a member fixed to the pulley and retaining the bearing within the pulley.

8. The vacuum cleaner of claim 7, wherein the member includes a bushing positioned at least partially within the pulley, and wherein the bushing engages the bearing to inhibit the pulley from moving off of the bearing.

9. The vacuum cleaner of claim 7, wherein the member includes a projection formed on the pulley, and wherein the projection engages the bearing to inhibit the pulley from moving off of the bearing.

10. The vacuum cleaner of claim 7, wherein the pulley defines a groove on an inner surface of the pulley, wherein the member includes a retaining ring positioned within the groove, and wherein the retaining ring engages the bearing to inhibit the pulley from moving off of the bearing.

11. The vacuum cleaner of claim 7, wherein the bearing is a first bearing positioned adjacent a first end of the pulley, and further comprising a second bearing positioned adjacent a second end of the pulley.

12. The vacuum cleaner of claim 11, wherein the shaft includes a shoulder that engages the second bearing, wherein the member includes a stop ring positioned around a portion of the shaft, and wherein the stop ring engages the first bearing to inhibit the pulley from moving off of the first and second bearings.

13. A pulley assembly operable to engage a belt in a floor cleaning machine, the pulley assembly comprising:
- a pulley rotatable about a shaft, the pulley having
  - a belt-engaging surface about an axis,
  - a bore along the axis and including a seat portion,
- a bearing positioned adjacent the seat portion in the bore, and
- a member retaining the bearing against the seat portion within the bore, the member bounding axial movement of the bearing in the bore.

14. The pulley assembly according to claim 13, wherein the bore is a stepped bore having a seat portion formed by a step of the stepped bore.

15. The pulley assembly according to claim 13, wherein the member includes a bushing positioned at least partially within the bore adjacent the bearing.

16. The pulley assembly according to claim 15, wherein the member includes a flange portion attached to an outer edge of the pulley.

* * * * *